US009380858B2

(12) United States Patent
Suralikal et al.

(10) Patent No.: US 9,380,858 B2
(45) Date of Patent: Jul. 5, 2016

(54) CLEANSING SYSTEM AND METHOD FOR DRINKING CONTAINERS

(71) Applicants: Mallinath Suralikal, Santa Clara, CA (US); Bharathi Suralikal, Santa Clara, CA (US)

(72) Inventors: Mallinath Suralikal, Santa Clara, CA (US); Bharathi Suralikal, Santa Clara, CA (US)

(73) Assignee: AQUALAYER, INC., Santa Clara, CA (US)

( * ) Notice: Subject to any disclaimer, the term of this patent is extended or adjusted under 35 U.S.C. 154(b) by 0 days.

(21) Appl. No.: 14/492,020

(22) Filed: Sep. 21, 2014

(65) Prior Publication Data

US 2015/0202667 A1 Jul. 23, 2015

Related U.S. Application Data

(60) Provisional application No. 61/929,031, filed on Jan. 18, 2014.

(51) Int. Cl.

| | |
|---|---|
| ***B08B 7/00*** | (2006.01) |
| ***A46B 11/00*** | (2006.01) |
| ***A46B 5/00*** | (2006.01) |
| ***A46B 13/02*** | (2006.01) |
| *B08B 9/087* | (2006.01) |
| *B08B 1/00* | (2006.01) |
| *B08B 9/00* | (2006.01) |
| *B08B 9/027* | (2006.01) |
| *C11D 7/10* | (2006.01) |
| *C11D 7/12* | (2006.01) |
| *C11D 7/26* | (2006.01) |

(52) U.S. Cl.

CPC ..... *A46B 11/0006* (2013.01); *A46B 5/0095* (2013.01); *A46B 11/002* (2013.01); *A46B 13/023* (2013.01); *A46B 2200/3006* (2013.01); *B08B 1/00* (2013.01); *B08B 1/002* (2013.01); *B08B 9/00* (2013.01); *B08B 9/027* (2013.01); *B08B 9/087* (2013.01); *C11D 7/10* (2013.01); *C11D 7/12* (2013.01); *C11D 7/265* (2013.01)

(58) Field of Classification Search

CPC ..... B08B 9/087; B08B 1/00; B08B 1/002; B08B 9/00; B08B 9/027; C11D 7/10; C11D 7/12; C11D 7/265

See application file for complete search history.

(56) References Cited

U.S. PATENT DOCUMENTS

| | | | | |
|---|---|---|---|---|
| 6,851,881 | B2 * | 2/2005 | Slaboden | A46B 11/0041 401/201 |
| 2005/0138742 | A1 * | 6/2005 | Jaszenovics | A47K 11/10 15/104.94 |
| 2008/0115302 | A1 * | 5/2008 | Kilkenny | A47L 13/254 15/104.94 |
| 2009/0188528 | A1 * | 7/2009 | Junkins | A46B 5/0095 134/6 |
| 2009/0194136 | A1 * | 8/2009 | Yamashiro, Jr. | B08B 1/00 134/8 |
| 2009/0211615 | A1 * | 8/2009 | Ho | B08B 3/12 134/56 R |
| 2011/0247653 | A1 * | 10/2011 | Rees | A47L 13/17 134/6 |
| 2012/0066851 | A1 * | 3/2012 | Gonzales | C11D 3/227 15/104.93 |
| 2015/0202667 | A1 * | 7/2015 | Suralikal | B08B 9/087 134/8 |

* cited by examiner

*Primary Examiner* — Bibi Carrillo
(74) *Attorney, Agent, or Firm* — Nwamu, P.C.

(57) ABSTRACT

A cleaner inserts into an unsanitary drinking container to clean the container. The cleaner comprises a cleaning at least one abrasive exterior surface or brush on said cleaner. The cleaning composition can be dispensed from within the at least one compartment into the container for cleaning.

3 Claims, 3 Drawing Sheets

CLEANSING SYSTEM AND METHOD FOR DRINKING CONTAINERS

CLAIM OF PRIORITY

The present application is a nonprovisonal patent application of U.S. Provisional Patent Application No. 61/929,031, filed Jan. 18, 2014, entitled Method of Cleaning the Water Bottle or Container.

BACKGROUND OF THE INVENTION

The present invention relates generally to container systems and methods and more specifically to container cleaning systems and methods for cleaning drink containers such as jugs, water bottles and the like.

Drink containers such as jugs, water bottles and the like that are used for drinking can easily become unsanitary. As an example, a drink container may become contaminated with microscopic organisms like algae that latch onto crevices in the unused drinking bottles after such bottles have been sitting for a while.

Algae growth is quite common in the summer when sunlight and warmer temperatures can cause algae to flourish in water bottles. Thus, in order to reuse the drinking containers, the water bottles must undergo a cleaning process.

A user wishing to clean a contaminated or unsanitary drinking container typically begins by adding liquid detergent or just detergent and water into the unsanitary drinking container. The user then shakes the mixture vigorously inside the unsanitary drinking container in order to remove the algae. After shaking or agitating the unsanitary container, the detergent and water mixture is then poured out of the bottle. Clean water is then added to rinse out the bottle. Oftentimes, the user then adds clean water a number of times in order to decontaminate and remove all of the soap as well as algae inside the container.

As the user continues to wash out the unsanitary container, the user may begin to realize that inordinate amounts of water is being used over and over to completely clean out the unsanitary container and to remove any traces of soap or detergent that may have been used in the cleaning process.

After the user is comfortable that the water bottle is clean, the user can then begin to use the water bottle again. As the user reuses the water bottle, particularly for the first time after cleaning, the user may nevertheless realize that remnants of the detergent remain in the water bottle. In some cases, the user may taste the toxic detergent in his or her mouth and may cause damage to the user's health.

It is within the aforementioned context that a need for the present invention has arisen. The foregoing background has been provided as context for the present invention and is not intended to highlight or indicate specific disadvantages of conventional systems to which the present invention is limited.

BRIEF SUMMARY OF THE INVENTION

Various aspects of a cleansing system and method for cleansing and sanitizing drinking containers can be found in exemplary embodiments of the present invention.

In one embodiment, the cleansing system and method is a cleaner that includes a mixing composition that can sanitize, clean and remove algae and other contaminants from the interior of an unsanitary drinking container. In one embodiment, the cleaner includes an interior compartment having a cleaning composition of 20 percent by weight of sodium chloride; 10 percent by weight of citric acid or lemon juice; and 70 percent by weight of sodium carbonate.

The cleaner may include at least one abrasive exterior surface or brush on said cleaner. Upon insertion of said cleaner into an unsanitary drinking container, manipulation of said drinking container causes the abrasive exterior surface or brush to agitate and disengage algae from interior walls of said container as well as dispense the cleaning composition to clean and sanitize the interior of said drinking container.

In this manner, users need not rely on detergents, soaps or the like to clean drinking containers as such chemicals may be toxic to users' life or health. The present invention can clean and sanitize drinking containers without the toxicity associated with conventional systems and methods.

A further understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the one embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth to provide a thorough understanding of the present invention. However, it will be obvious to one of ordinary skill in the art that the present invention may be practiced without these specific details. In other instances, well-known methods, procedures, components, and circuits have not been described in detail as to not unnecessarily obscure aspects of the present invention.

Figure 1:
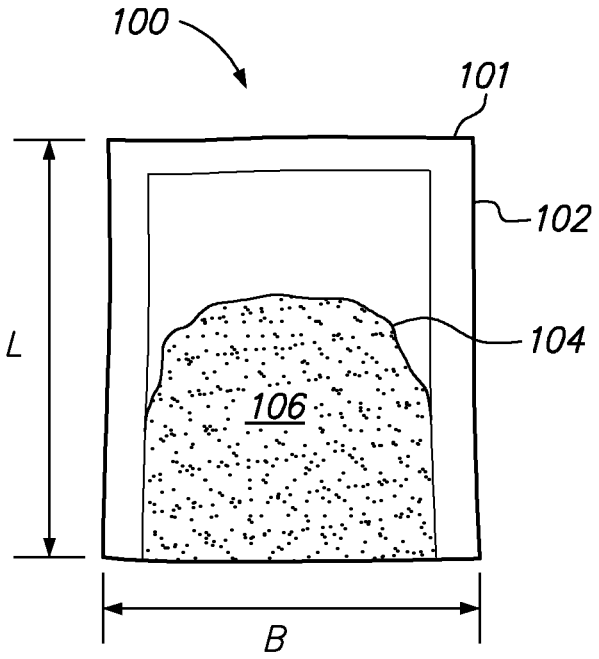
FIG. 1 illustrates a cleaning system according to an exemplary embodiment of the present invention.

FIG. 1 illustrates cleaning system 100 according to an exemplary embodiment of the present invention.

In FIG. 1, cleaning system 100 may comprise sachet 101 having an outer preferably abrasive exterior 102 as well as at least one interior compartment 104. Abrasive exterior 102 may comprise woven material or other such materials capable of dislodging algae and other such contaminants when in contact with such contaminants. Interior compartment 104 is configured to hold cleaning composition 106 that can sanitize the interior of an unsanitary preferably, drinking container.

In accordance with embodiments of the present invention, cleaning composition 106 has none of the disadvantages of the prior art. Unlike prior art cleaning systems where toxic detergents are used to sanitize drinking containers, cleaning composition 106 contains home grade compositions that are neither toxic nor can adversely impact the health of the user.

As shown in FIG. 1, in one embodiment, sachet 101 is semi-permeable to fluids. In an alternate embodiment, sachet 101 is completely permeable. Thus, cleaning composition 106 (within sachet 101) can dissolve in water and be dispensed through sachet 101 into an interior area of an unsanitary drinking container to facilitate cleaning of said container.

Here, note that in FIG. 1, sachet 101 of cleaning system 100 is square-shaped, although one skilled in the art will realize that any shape consistent with the spirit and scope of the present invention can be utilized. In this embodiment, the length L of sachet 101 may be between 1 and 4 inches. The breadth B may also be between 1 and 4 inches as well. Irrespective, the dimensions of sachet 101 are configured such that sachet 101 is insertable into a drinking container or an unsanitary water bottle, jug or the like for cleaning and sanitization. Use of cleaning system 100 will be described with reference to FIGS. 3 and 4 of the present application.

Figure 2:
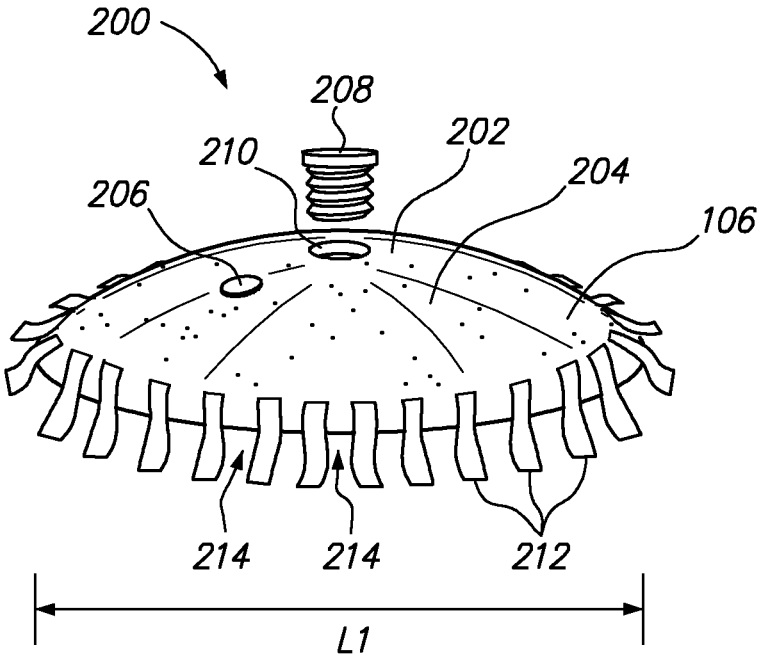
FIG. 2 illustrates a cleaning system according to another exemplary embodiment of the present invention.

FIG. 2 illustrates cleaning system 200 according to an exemplary embodiment of the present invention.

In FIG. 2, cleaning system 200 comprises electronic agitator 202 which itself includes an interior compartment 204. Electronic agitator 202 is battery powered and is configured to agitate or vibrate upon selection of power button 206.

Interior compartment 204 is configured to hold cleaning composition 106. Cleaning composition may consist of solid, spherical particles that are soluble in water, or liquid or semi-liquid composition. Cleaning composition 106 can be introduced into electronic agitator 202 by unscrewing cap 208 and then inserting the cleaning mix into interior compartment 204 via opening 210.

Thereafter, cap 204 can then be rotated in a clockwise direction to close opening 210 of electronic agitator 202. Electronic agitator 202 also includes a plurality of abrasive brushes 212 that are preferably flexible.

Abrasive brushes 212 may be made of hard PVC type brushes or may be made of abrasive woven material or a thick cloth. Electronic agitator 202 further includes a plurality of apertures 214. Each aperture 214 is configured to allow cleaning composition 106 to either flow through or drop through when water is added into an unsanitary drinking container.

Exemplary length L1 of electronic agitator 202 can be a half inch-12 inches but can be configured in such a matter that it can fit into the opening of a drinking container. A plurality of sizes can be made available to fit within various sized drinking containers including small long neck bottles/containers as well as wide mouth one up to 12" in diameter. Note also that when electronic agitator 220 is inserted with no handle, the power and movement direction can be controlled using remote from outside the bottle. Moreover, electronic agitator 202 may also rotate and vibrate as well. Use of cleaning system 200 and electronic agitator 202 will be described with reference to FIGS. 3 and 4.

Figure 3:
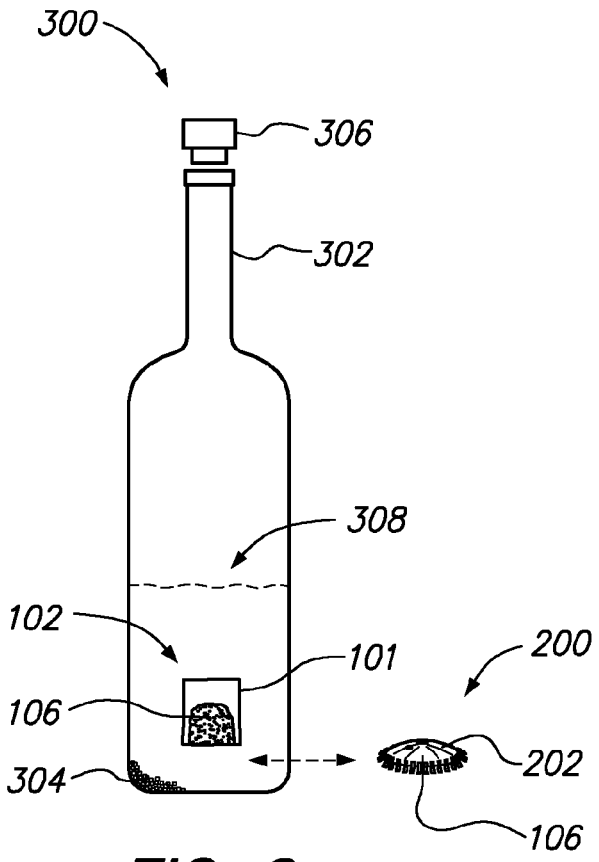
FIG. 3 illustrates an unsanitary drinking container to be sanitized in accordance with an exemplary embodiment of the present invention.

FIG. 3 illustrates unsanitary drinking container 300 that is to be sanitized in accordance with an exemplary embodiment of the present invention.

In FIG. 3, specifically, unsanitary drinking container 300 includes a long neck 302 that makes it particularly difficult for a user to insert a hand into the container for cleaning. Unsanitary drinking container 300 might also include algae 304 that has latched on and is growing on the inside wall of unsanitary drinking container 300.

Figure 4:
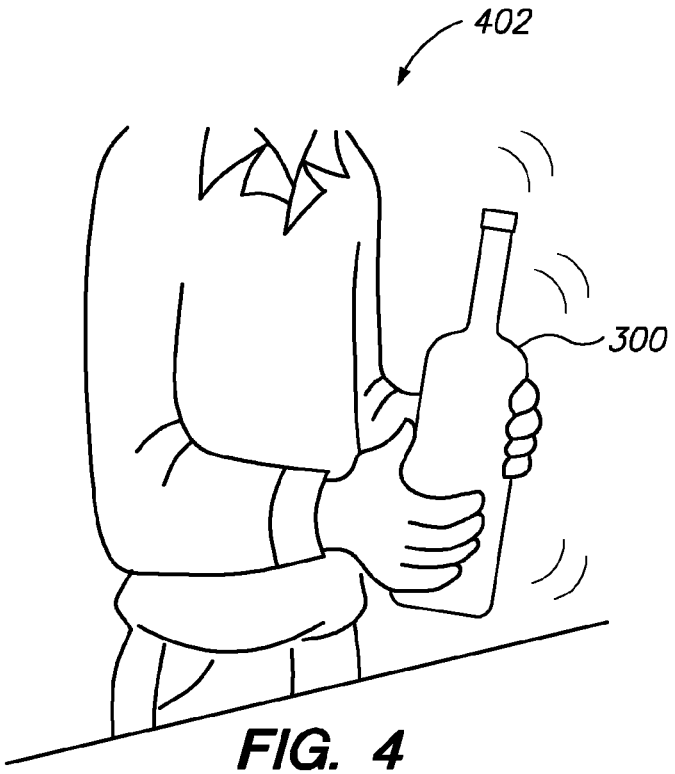
FIG. 4 illustrates user agitation of the unsanitary drinking container of FIG. 3 according to an exemplary embodiment of the present invention.

In use and with reference to FIG. 1, as well as with reference to FIG. 4, a user 402 (of FIG. 3) that wishes to clean, sanitize or decontaminate unsanitary drinking container 300 begins by inserting sachet 101 (FIG. 1) into the unsanitary drinking container as shown. Here, sachet 101 is shown in FIG. 3 inside unsanitary drinking container 300. User 402 wishes to clean unsanitary drinking container 300 and remove algae 304 in its entirety from the container.

After sachet 101 is inserted into unsanitary drinking container 300, about one cup, 250 milliliters, or 8.3 ounces; or 2 cups, 500 milliliters or 16.3 ounces of water is added into unsanitary drinking container 300. The container is then closed with the cap 306. User 402, as shown in FIG. 4, then begins to vigorously agitate the unsanitary drinking container 300 such that mixing composition 106 within sachet 101 begins to dissolve through the permeable membrane of sachet 101 with the water 308 added into unsanitary drinking container 300.

As the container is agitated, in addition to mixing composition 106 dissolving in water 308, the abrasive exterior of sachet 101 begins abrade and dislodge algae 304. User 402 continues to agitate unsanitary drinking container 300 until all of the algae is completely removed and the entirety of the inside of the container is sanitized.

Thereafter, the contents of unsanitary drinking container 300—namely the water and the used sachet 101—are then poured out of the container and discarded. Fresh water is then poured into the container and is used to rinse the container once and preferably twice with the clean water. The unsanitary drinking container 300 is now sanitized and is ready for use. An advantage of the present invention is the novel mixing composition 106 employed within sachet 101. Mixing composition 106 includes an optimum composition of sodium bicarbonate (baking soda), citric acid (lemon juice) and sodium chloride (salt).

The inventors of the present invention tested various combinations of cleaning composition 106. As shown in Example 1, a composition comprised of 35% sodium bicarbonate, 35% citric acid and 30 percent sodium chloride was tested with 1 or 2 cups of water for cleaning and unsanitary container. The result is as follows:

Example 1

| Example 1 | | | |
|---|---|---|---|
| Sodium bicarbonate | Citric acid | Sodium chloride | Results |
| 35% | 35% | 30% | Poor |

This combination was used to attempt to clean an unsanitary drinking container. The result, as seen in Example 1, was poor. Specifically, some of the contamination was removed and cleaned, but overall, some contamination was left, and the container was not properly sanitized.

As shown in Example 2, a mixing composition of 50% sodium bicarbonate, 20% citric acid and 30 percent sodium chloride was then tested.

Example 2

| Example 2 | | | |
|---|---|---|---|
| Sodium bicarbonate | Citric acid | Sodium chloride | Results |
| 50% | 20% | 30% | Better |

The result here was better relative to Example 1, but the container was still not fully sanitized.

As shown in Example 3, a mixing composition of 60 percent sodium bicarbonate, 15% citric acid and 25% sodium chloride was then tested.

Example 3

| Example 3 | | | |
|---|---|---|---|
| Sodium bicarbonate | Citric acid | Sodium chloride | Results |
| 60% | 15% | 25% | Good |

The result was generally good relative to Example 1 and Example 2.

As shown in Example 4, a mixing composition comprising 70% sodium bicarbonate, 13% citric acid and 20% sodium chloride was then tested, and the result was very good.

Example 4

| Example 4 | | | |
|---|---|---|---|
| Sodium bicarbonate | Citric acid | Sodium chloride | Results |
| 70% | 10% | 20% | Very good |

The composition of Example 4 was optimum and is the preferred composition in one embodiment of the present invention.

As shown in Example 5, the same composition of Example 4, namely 70% sodium bicarbonate, 10% citric acid and 20% sodium chloride was also used, but this time, the mixing composition was retained inside of sachet as shown in FIG. 1.

Example 5

| Example 5 | | | | |
|---|---|---|---|---|
| Sodium bicarbonate | Citric acid | Sodium chloride | Sachet or Agitator Used | Results |
| 70% | 10% | 20% | | Best/Excellent |

This composition, in combination with the sachet or agitator, described below, yielded the best results. The abrasive exterior of the sachet was able to rub against the inside of the unsanitary drinking container 300 while at the same time dispensing the mixing composition into the added water that was used to facilitate cleaning of the drinking container.

Once the mixing composition of the present invention was used to sanitize and unsanitary container, it was safe generally for human use, and unlike prior art systems that can be toxic to human health when detergents or the like are used for cleaning; the generally home grade mixing composition of the present invention as disclosed was very effective and non-toxic to human health and life.

Use of the electronic agitator 202 of FIG. 2 will now be described with reference to FIG. 3 and FIG. 4.

In use, electronic agitator 202 is inserted into unsanitary drinking container 300. As shown in FIG. 3, sachet 101 is replaced by cleaning system 200 and electronic agitator 202. Prior to insertion of the electronic agitator 202, power button 206 is selected which causes the electronic agitator 202 to begin to vibrate.

Water 308 is then added to the container, and cap 306 is applied to cover the container. User 402 need not agitate container 300 as the electronic agitator 202 is self-propelled and begins to move within container 300 to clean algae 304; contemporaneously, mixing composition 106 is dispensed from an interior compartment of agitator 202.

After the unsanitary drinking container 300 is sanitized, electronic agitator 202 is removed along with water 308 and discarded. An advantage of the present invention here is that electronic agitator 202 need not be discarded as it can be refilled with mixing composition 106 for repeated future use.

Figure 5:
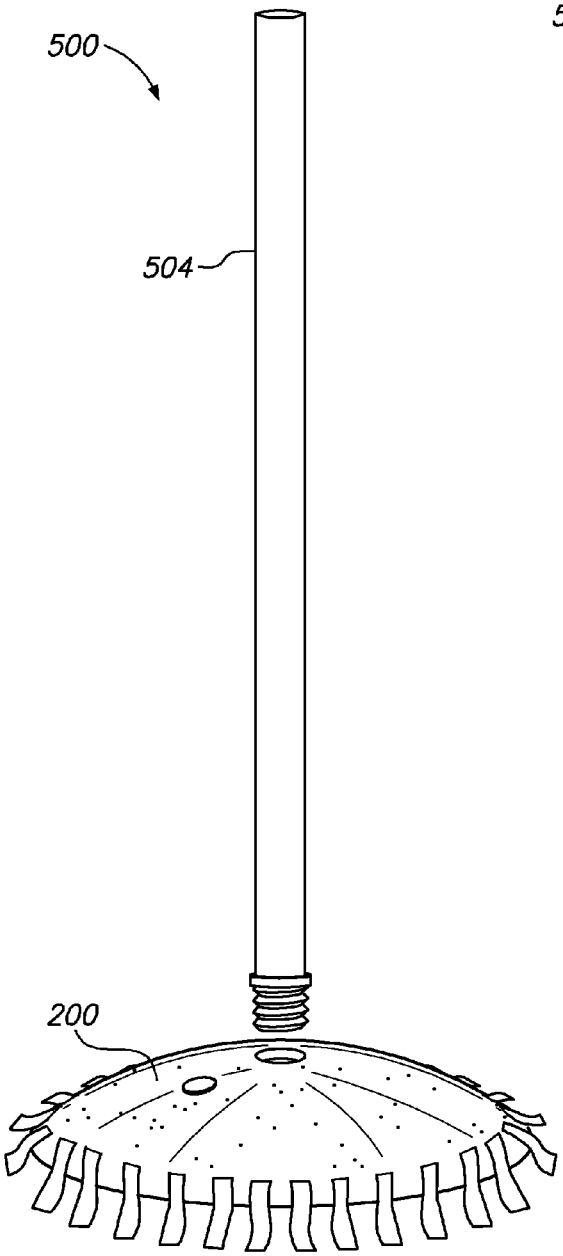
FIG. 5 shows the cleaning system of FIG. 2 with a handle according to an exemplary embodiment of the present invention.

FIG. 5 shows cleaning system 500 according to an exemplary embodiment of the present invention.

Figure 6:
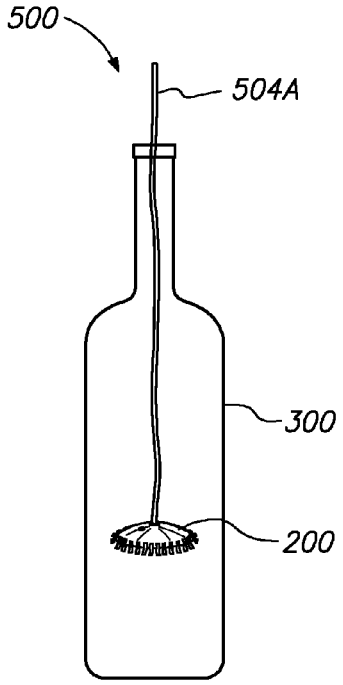
FIG. 6 shows use of the cleaning system of FIG. 5 in an unsanitary drinking container.

More specifically, cleaning system 500 is simply agitator 202 of FIG. 2 to which a handle 504 is attached. In this manner, with or without the agitator power button turned on, user 402 can manually use cleaning system 500 and specifically hold handle 504 as shown in FIG. 6 for inserting electronic agitator 202 into an unsanitary drinking container 300 for cleaning. User 402 can insert and withdraw and use handle 504A to manipulate electronic agitator 202. Although not shown, in another embodiment, handle 504 may be detachable, and may be flexible akin to thick wire that can be bent to any angle.

Figure 7:
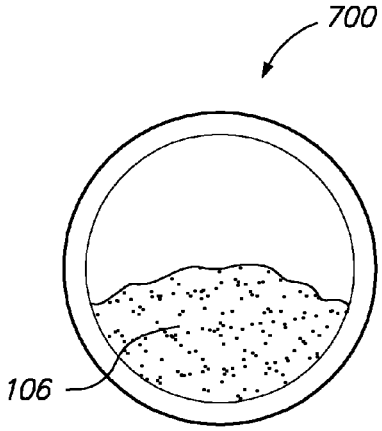
FIG. 7 illustrates a cleaning system according to another exemplary embodiment of the present invention.

FIG. 7 illustrates sachet cleaning system 700 according to an exemplary embodiment of the present invention.

In FIG. 7, the exterior of sachet cleaning system 700 might be composed of thick paper towels or thick cloth surfaces that are highly absorbent. The rough or abrasive edges of thick cloth surfaces can absorb water with floating algae and clean out the inside of unsanitary containers.

An interior compartment of sachet cleaning system can contain mixing composition 106 as previously described with reference to other embodiments of the present invention. In this manner, embodiments of the present invention, having cleaning composition, including sodium bicarbonate, sodium chloride and citric acid can be used for cleaning and releasing algae from the interior surface of unsanitary containers, and to clean out stains and eliminate bacteria. The agitator device of the present invention can be dropped inside an unsanitary container and sanitize the container without human intervention. When powered up, the agitator device rotates and brushes and releases the mixing composition contained therein in solid form, semi-solid form or liquid form.

While the above is a complete description of exemplary specific embodiments of the invention, additional embodiments are also possible. Thus, the above description should not be taken as limiting the scope of the invention, which is defined by the appended claims along with their full scope of equivalents.

We claim:

1. A method of cleaning unsanitary drinking water containers comprising:

providing a cleaning device insertable into an interior of an unsanitary drinking water container to clean the interior of said unsanitary drinking water container, said cleaning device having at least one interior compartment;

providing a cleaning composition directed to cleaning unsanitary drinking water containers, the cleaning composition consisting of:

15-25 percent by weight of sodium chloride;

5-15 percent by weight of citric acid or lemon juice; and 68-78 percent by weight of sodium bicarbonate;

providing at least one abrasive exterior surface or brush on said cleaning device;

introducing said cleaning composition into said interior compartment of said cleaning device;

inserting the cleaning device into the unsanitary drinking water container such that the cleaning device is entirely within the interior of the unsanitary drinking water container;

introducing water into the unsanitary drinking water container; and grasping and shaking said unsanitary drinking water container to agitate the water and the cleaning device around the interior of the unsanitary drinking water container such that said cleaning composition is dispensed from within the at least one interior compartment of the cleaning device into the interior of said container and said at least one abrasive exterior surface or brush agitates and disengages algae from interior walls of said container.

2. The method of claim 1 wherein said cleaning device is a sachet with at least one abrasive surface.

3. The method of claim 1 wherein said cleaning device is an electronic agitator with an exterior brush.

* * * * *